US006053778A

United States Patent [19]

Ivan et al.

[11] Patent Number: 6,053,778

[45] **Date of Patent: *Apr. 25, 2000**

[54] RIGIDIZING COVER PLATE FOR A PRINTED WIRING BOARD MOUNTED TERMINAL BLOCK

[75] Inventors: William John Ivan, Woodbridge, N.J.; Robin R. Ruzek, Omaha, Nebr.

[73] Assignee: Lucent Technologies, Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/013,670

[22] Filed: Jan. 26, 1998

[51] Int. Cl.[7] ..... H01R 9/22

[52] U.S. Cl. ..... 439/718; 439/731; 439/540.1

[58] Field of Search ..... 439/718, 712–714, 439/709, 723–724, 725, 731–732, 733, 540.1, 544, 562

[56] References Cited

U.S. PATENT DOCUMENTS

| | | | |
|---|---|---|---|
| 5,023,752 | 6/1991 | Detter et al. | 361/399 |
| 5,285,011 | 2/1994 | Shimochi | 174/52.1 |
| 5,545,057 | 8/1996 | Tan et al. | 439/540.1 |
| 5,622,506 | 4/1997 | Hornig et al. | 439/74 |
| 5,718,047 | 2/1998 | Nakayama et al. | 29/845 |
| 5,741,153 | 4/1998 | Schwer | 439/491 |

*Primary Examiner*—Lincoln Donovan
*Attorney, Agent, or Firm*—Duft, Graziano & Forest, P.C.

[57] ABSTRACT

A rigidizing cover plate for a printed circuit board mounted terminal block eliminating the instability of a 110D terminal block when it is mounted on the printed circuit board. The cover plate is a one piece injection molded polycarbonate plate that can be color coordinated to augment the existing 110D terminal blocks. The cover plate is formed with a plurality of apertures to enable the craftsperson to access the 110D terminal blocks that are mounted on the printed circuit board. The apertures formed in the cover plate contact the base of the corresponding 110D terminal block and provide lateral support for the terminal block to prevent movement of the terminal block with respect to the printed circuit board. The cover plate, when secured to the printed circuit board, functions not only as a stabilizer, but also as a protective shroud for the printed wiring board traces. The cover plate can be attached to a corresponding cover plate located on the back side of the printed circuit board, which additional cover plate functions as a stand-off for the printed wiring board sub-assembly. The cover plate can also be used for additional product labeling.

11 Claims, 3 Drawing Sheets

RIGIDIZING COVER PLATE FOR A PRINTED WIRING BOARD MOUNTED TERMINAL BLOCK

FIELD OF THE INVENTION

This invention relates to terminal blocks and in particular to a printed wiring board mounted terminal block and the associated multi-function cover plate as a printed wiring board rigidizing and terminal block stabilizing element.

PROBLEM

It is a problem in the field of printed wiring board mounted terminal blocks, that the printed wiring board provides insufficient rigidity to prevent the terminal block from rocking when it is affixed to the printed wiring board. For example, a 110D terminal block is designed to be attached directly to a printed wiring board as illustrated in FIG. 3 which presents a side cross-section view of a prior art printed wiring board 125 that has a terminal block 127 mounted thereon by either press fit Insulation Displacement Contact (IDC) tails or solder-to-board type IDC tails (AAB, AAC). When assembled, the mechanical stability and the physical strength of the assembly is solely dependent on the soldered or press-fit interface between the IDC tails AAB, AAC and the printed wiring board 125. The application of a force to the terminal block 127 in a direction other than directly down on the terminal block 127 in direction D, causes the terminal block 127 to rock on its soldered connection in the directions illustrated by the arrow labeled R, into the positions illustrated by the dotted line drawings 126, 128 of the terminal block.

Thus, the installation of cross-connect wiring in the terminal block had to be effected in a manner that did not overload the mechanical stability of the interface between the IDC tails AAB, AAC and the printed wiring board 125. In the physical plant environment, it is typical to use a patch cord that has a patch plug connector terminated at each end to interconnect terminal blocks, where a patch plug connector is a plastic housing that contains electrical contacts assembled into a single unit. A patch cord is an assembly consisting of an outer jacket surrounding individually insulated wire conductors. However, only punch-down wire, comprising individual wires inserted into individual Insulation Displacement Contact slots, was approved as the method of making cross-connects in the printed wiring board mounted 110D terminal blocks, since the punch-down wire inflicts much less punishment on the interface between the IDC tails AAB, AAC and the printed wiring board 125 than does a patch cord. However, when patch cords are used to make cross connections, electrical performance is greatly improved. It is therefore desirable that the printed wiring board mounted 110D terminal block works with patch cords. However, the stability of the 110D terminal blocks/printed wiring board assembly must be improved to enable the use of patch cords.

SOLUTION

The above-described problems are solved and a technical advance achieved in the field by the present rigidizing cover plate for a printed wiring board mounted terminal block that eliminates the instability of the 110D terminal block when it is mounted on the printed circuit board. The cover plate is a one piece injection molded polycarbonate plate that can be color coordinated to augment the existing 110D terminal blocks. The cover plate is formed with a plurality of apertures to enable the craftsperson to access the 110D terminal blocks that are mounted on the printed circuit board. The apertures formed in the cover plate contact the base of the corresponding 110D terminal block and provide lateral support for the terminal block to prevent movement of the terminal block with respect to the printed circuit board. The cover plate, when secured to the printed circuit board, functions not only as a stabilizer, but also as a protective shroud for the printed wiring board traces which are the signal transmission paths photochemically etched on the surfaces of the printed wiring board. The cover plate can be attached to a corresponding cover plate located on the back side of the printed circuit board which additional cover plate functions as a stand-off for the printed wiring board sub-assembly. The cover plate can also be used for additional product labeling.

DETAILED DESCRIPTION

Figure 1:
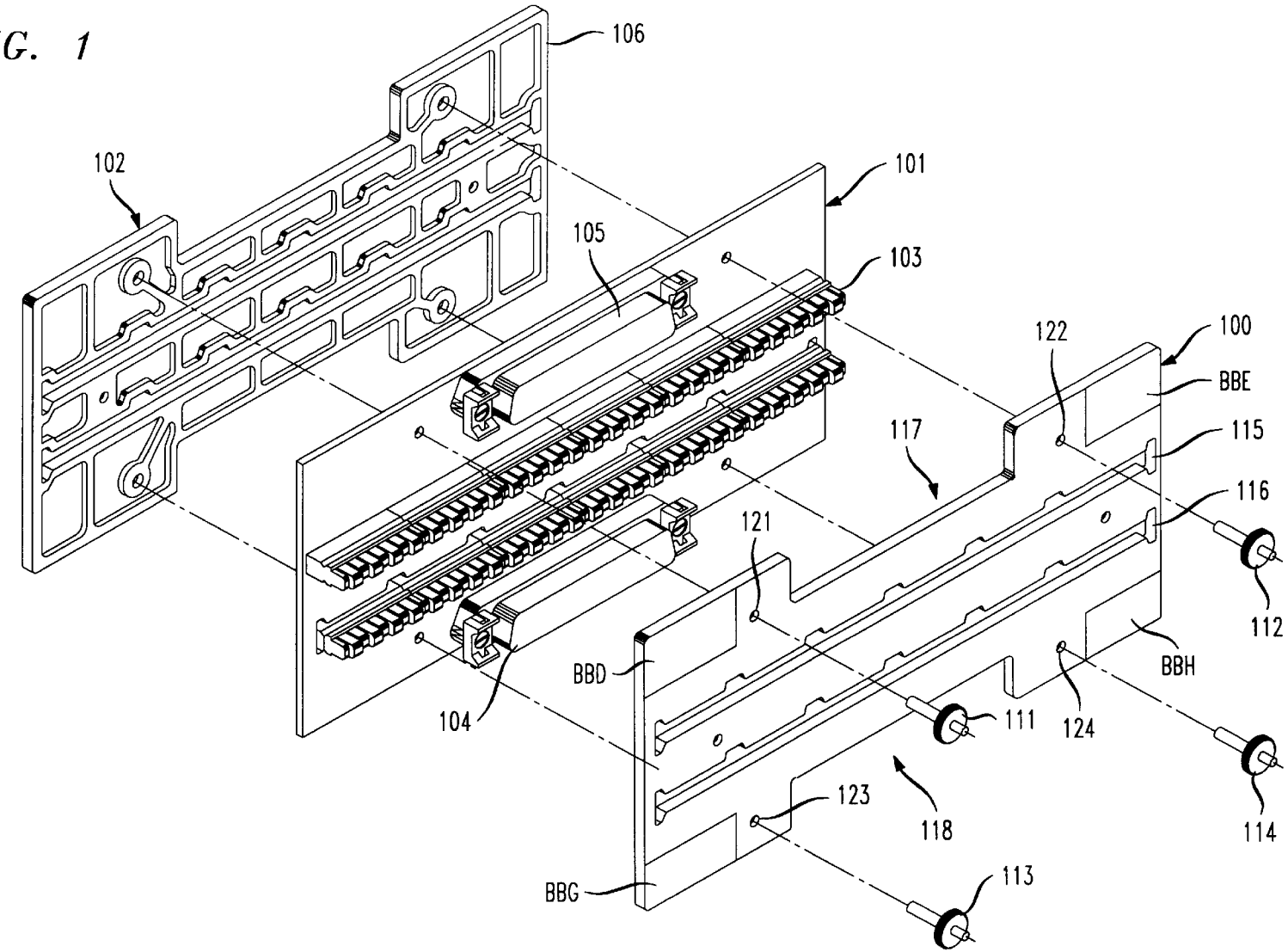
FIG. 1 illustrates an exploded perspective view of the present rigidizing cover plate for a printed wiring board mounted terminal block along with the corresponding printed wiring board and stand-off cover plate for mounting on the back side of the printed circuit board.
Figure 2:
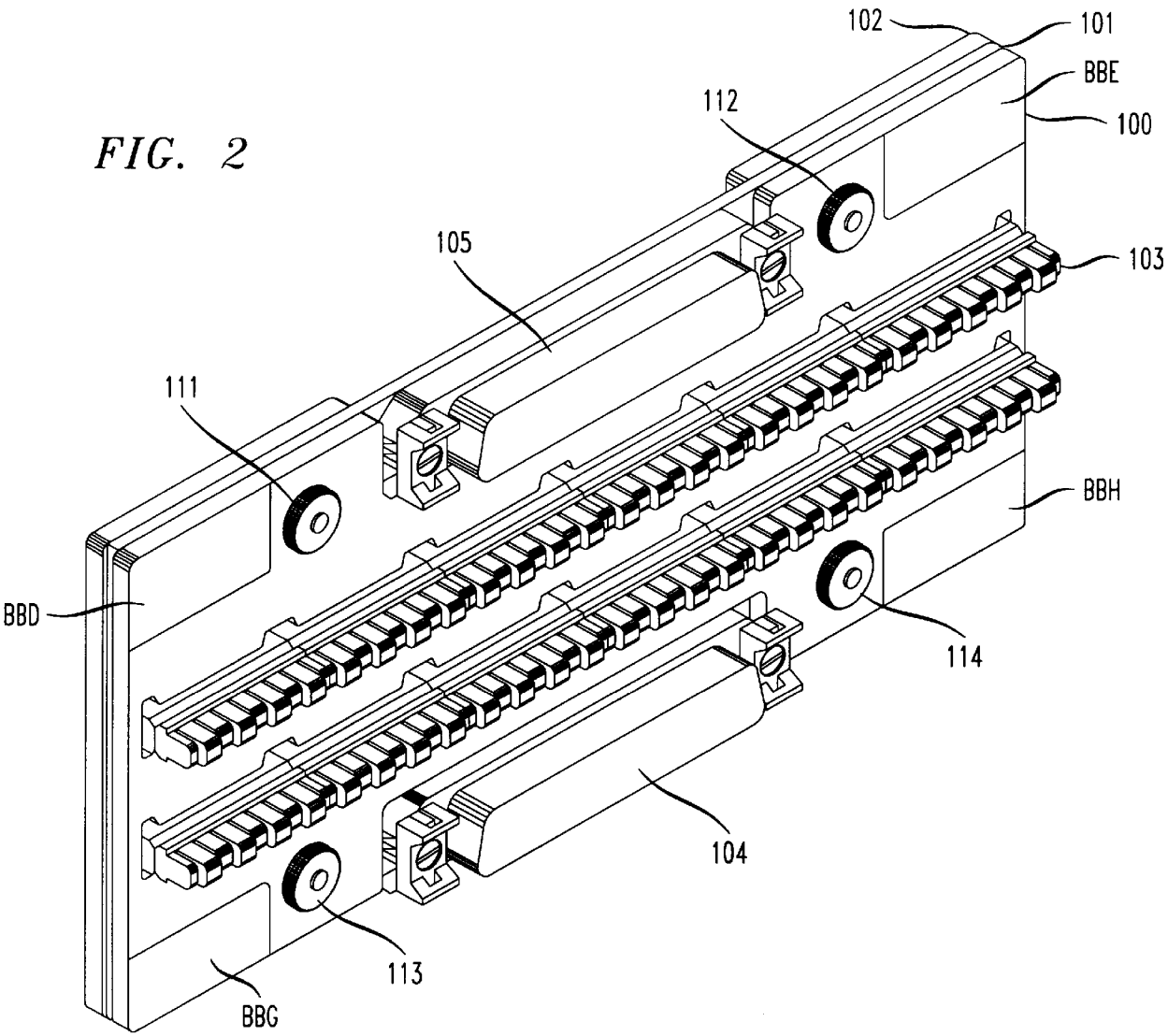
FIG. 2 illustrates a perspective view of the apparatus of FIG. 1 in the assembled form.
Figure 3:
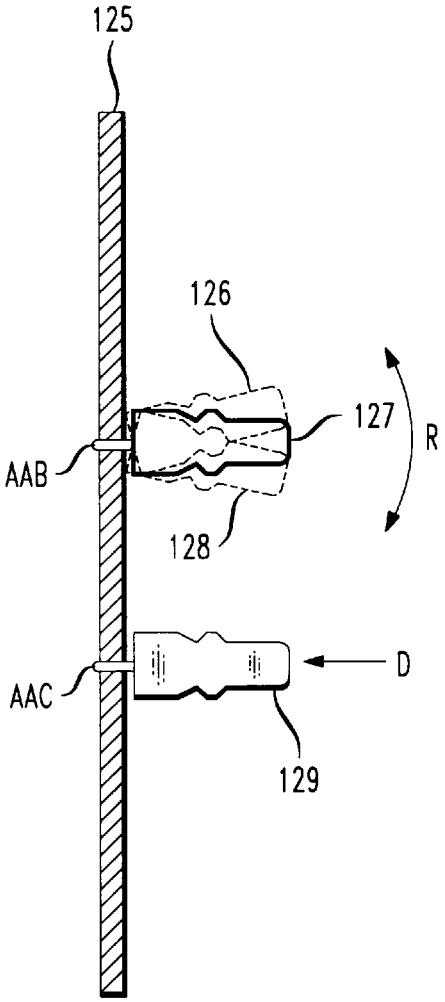
FIG. 3 PRIOR ART
FIG. 3 illustrates a side cross-section view of a typical prior art printed wiring board mounted terminal block.
Figure 4:
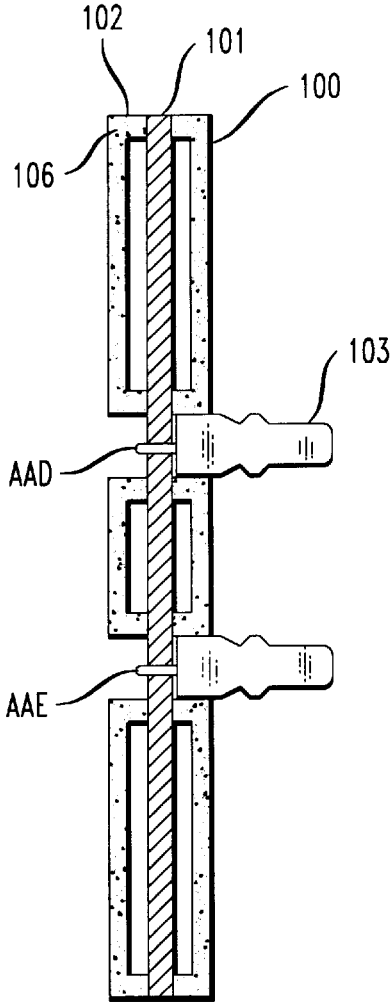
FIG. 4 illustrates a side cross-section view of the apparatus of FIG. 2.

FIG. 1 illustrates an exploded perspective view of the present rigidizing cover plate 100 for a printed wiring board mounted terminal block used with a printed wiring board as both a rigidizing cover plate and as a stand-off. FIG. 2 illustrates a perspective view of the apparatus of FIG. 1 in the assembled form, while FIG. 4 illustrates a side cross-section view of the apparatus of FIG. 2. The printed wiring board 101 has mounted thereon a plurality of the 110D-type terminal blocks 103 and, optionally, standard miniature ribbon-type connectors 104, 105. The 110D terminal blocks 103 are attached directly to printed wiring board 101 by either press fit Insulation Displacement Contact (IDC) tails or solder-to-board type IDC tails AAD, AAE (FIG. 4).

The present rigidizing cover plate 100 for a printed wiring board mounted terminal block is comprised of an electrically non-conductive material formed as a one piece injection molded polycarbonate flat plate that can be color coordinated to augment the existing 110D terminal blocks 103. The cover plate 100 is formed with a plurality of apertures 115, 116 that are of dimensions and location such that the edges of the apertures 115, 116 contact at least two of the sides (typically opposing sides) of the terminal blocks 103 to prevent lateral movement of the terminal blocks 103. The top of the terminal blocks 103 protrude through the apertures 115, 116 to enable the craftsperson to access the 110D terminal blocks 103 that are mounted on the printed circuit board 101 when the cover plate 100 is affixed to the printed wiring board 101. The cover plate 100 is affixed to the printed wiring board 101 by means of a plurality of rivets 111–114 or other fasteners that are inserted through holes 121–124 formed in the cover plate and corresponding holes formed in the printed circuit board 101. In the instance of a second cover plate 102 (the back side of which is shown in FIG. 1) being used as a back plate, the fasteners 111–114 pass through the holes 121–124 124 formed in this second cover plate 102. Thus, in the case where two cover plates are used, the printed circuit board 101 is sandwiched between the top cover plate 100 and the backing cover plate 102, with the sandwich being held together by the fasteners 111–114.

The apertures 115, 116 formed in the cover plate 100 contact the base of the corresponding 110D terminal block 103 and provide lateral support for the terminal block 103 (as shown in cross-section view in FIG. 4) to prevent movement of the terminal block 103 with respect to the printed circuit board 101. The cover plate 100 is formed with a lip 106 located around the periphery of the cover plate 100 and around the periphery of each of the apertures 115, 116 to elevate the top surface of the cover plate 100 a predetermined distance above the corresponding top surface of the printed wiring board 101 to thereby provide lateral support for the terminal block 103 at a predetermined distance above the printed wiring board surface while enabling the cover plate 100 to be manufactured with a reduced thickness material. The cover plate 100, when secured to the printed circuit board 101, functions not only as a stabilizer, but also as a protective shroud for the printed wiring board traces. The additional cover plate 102, located on the back side of the printed circuit board 101, contains a lip 106 which functions as a stand-off for the printed wiring board sub-assembly. The cover plate 100 can also be used for additional product labeling, in the areas BBD, BBE, BBG, BBH provided on the cover plate 100. Furthermore, cover plate 100 contains apertures 117, 118 formed therein to enable the craftsperson to access the connectors 104, 105 that are mounted on the printed circuit board 101.

What is claimed:

1. Apparatus for supporting a plurality of terminal blocks, each of said terminal blocks comprising a plurality of conductive elements, each of said conductive elements having a body and a contact protruding therefrom, which contact is substantially smaller in width than said body, said plurality of terminal blocks being mounted on a printed circuit board exclusively by means of said contacts protruding from a back side of said terminal blocks, comprising:

a cover plate formed of an electrically non-conductive material; and at least one aperture formed in said cover plate, wherein edges of said at least one aperture contact at least two sides of said plurality of terminal blocks for impeding lateral movement of said plurality of terminal blocks.

2. The apparatus of claim 1 further comprising:

a lip formed around the periphery of said at least one aperture to contact said at least two sides of said plurality of terminal blocks for impeding lateral movement of said plurality of terminal blocks.

3. The apparatus of claim 2 wherein said lip is of dimensions to enable a portion of said plurality of terminal blocks to protrude above a top surface of said cover plate when said cover plate is affixed to said printed circuit board.

4. The apparatus of claim 1 further comprising:

a plurality of holes formed in said cover plate for receiving corresponding fasteners to enable the interconnection of said cover plate to said printed circuit board.

5. The apparatus of claim 4 further comprising:

a plurality of fasteners of length to extend through corresponding ones of said plurality of holes formed in said cover plate, through said printed circuit board to engage a second cover plate located juxtaposed to a back surface of said printed circuit board.

6. The apparatus of claim 4 further comprising:

a plurality of fasteners of length to extend through corresponding ones of said plurality of holes formed in said cover plate, to engage said printed circuit board; and wherein said plurality of holes are located in positions to rigidize said printed circuit board when said plurality of fasteners are inserted through said holes to secure said cover plate to said printed circuit board.

7. Apparatus for supporting a plurality of Insulation Displacement Contacts, each of said Insulation Displacement Contacts comprising a plurality of conductive elements, each of said conductive elements having a body and a contact protruding therefrom, which contact is substantially smaller in width than said body, said plurality of Insulation Displacement Contacts being mounted on a printed circuit board exclusively by means of electrical contacts protruding from a back side of said Insulation Displacement Contacts, comprising:

a cover plate formed of an electrically non-conductive material;

at least one aperture formed in said cover plate, wherein edges of said at least one aperture contact at least two sides of said plurality of Insulation Displacement Contacts for impeding lateral movement of said plurality of Insulation Displacement Contacts;

a plurality of holes formed in said cover plate for receiving corresponding fasteners to enable the interconnection of said cover plate to said printed circuit board; and a plurality of fasteners of length to extend through corresponding ones of said plurality of holes formed in said cover plate, to engage said printed circuit board.

8. The apparatus of claim 7 further comprising:

a lip formed around the periphery of said at least one aperture to contact said at least two sides of said plurality of Insulation Displacement Contacts for impeding lateral movement of said plurality of Insulation Displacement Contacts.

9. The apparatus of claim 8 wherein said lip is of dimensions to enable a portion of said plurality of Insulation Displacement Contacts to protrude above a top surface of said cover plate when said cover plate is affixed to said printed circuit board.

10. The apparatus of claim 7 further comprising:

a backing plate located juxtaposed to a back surface of said printed circuit board; and wherein said plurality of fasteners are of length to extend through corresponding ones of said plurality of holes formed in said cover plate, through said printed circuit board to engage said backing plate.

11. The apparatus of claim 7 wherein said plurality of holes are located in positions to rigidize said printed circuit board when said plurality of fasteners are inserted through said holes to secure said cover plate to said printed circuit board.

* * * * *